US008464476B2

(12) United States Patent
Roberts

(10) Patent No.: US 8,464,476 B2
(45) Date of Patent: Jun. 18, 2013

(54) MODULAR CONSTRUCTION ELEMENTS

(76) Inventor: Matthew William Lewis Roberts, Chilton (GB)

( * ) Notice: Subject to any disclaimer, the term of this patent is extended or adjusted under 35 U.S.C. 154(b) by 0 days.

(21) Appl. No.: 12/450,413

(22) PCT Filed: Mar. 27, 2008

(86) PCT No.: PCT/GB2008/001128

§ 371 (c)(1),
(2), (4) Date: Oct. 8, 2009

(87) PCT Pub. No.: WO2008/117080

PCT Pub. Date: Oct. 2, 2008

(65) Prior Publication Data

US 2010/0058676 A1 Mar. 11, 2010

(30) Foreign Application Priority Data

Mar. 27, 2007 (GB) ..... 0705867.0
May 25, 2007 (GB) ..... 0710019.1

(51) Int. Cl.
*E04B 1/19* (2006.01)
*E04H 14/00* (2006.01)

(52) U.S. Cl.
USPC ..... 52/80.1; 52/81.1; 52/79.4; 52/271; 446/102; 446/108; 446/124

(58) Field of Classification Search
USPC ..... 446/102–105, 114–116, 106, 107, 446/124–125, 127–128, 108–109, 95, 112, 446/487, 486, 488, 120–121, 122; 52/DIG. 10, 52/591, 594, 80.1–80.2, 81.1–81.6, 578–581, 52/581.1, 582.1, 79.1–179, 284; 434/43
See application file for complete search history.

(56) References Cited

U.S. PATENT DOCUMENTS

| | | | | | |
|---|---|---|---|---|---|
| 2,776,521 | A * | 1/1957 | Zimmerman | 446/115 |
| 3,026,651 | A * | 3/1962 | Richter | 52/81.4 |
| 3,332,178 | A * | 7/1967 | Foster | 52/70 |
| 3,871,143 | A * | 3/1975 | Quick | 52/309.1 |
| 4,309,852 | A * | 1/1982 | Stolpin | 52/81.3 |
| 4,509,930 | A * | 4/1985 | Schweigert et al. | 446/109 |
| 4,685,892 | A * | 8/1987 | Gould et al. | 446/109 |
| 4,731,041 | A * | 3/1988 | Ziegler | 446/115 |
| 4,874,341 | A * | 10/1989 | Ziegler | 446/109 |
| 4,902,259 | A * | 2/1990 | Ziegler | 446/117 |
| 6,142,848 | A * | 11/2000 | Madner et al. | 446/115 |
| 6,186,855 | B1 * | 2/2001 | Bauer et al. | 446/104 |
| 6,500,007 | B2 * | 12/2002 | Pupulin | 434/171 |
| 6,508,690 | B2 * | 1/2003 | Axelrad | 446/108 |
| 6,592,421 | B1 * | 7/2003 | Clever | 446/108 |
| 6,648,715 | B2 * | 11/2003 | Wiens et al. | 446/121 |
| 7,784,232 | B2 * | 8/2010 | Nygren et al. | 52/285.3 |
| 2008/0066393 | A1 * | 3/2008 | Sorensen | 52/81.1 |

* cited by examiner

*Primary Examiner* — Jeanette E. Chapman
(74) *Attorney, Agent, or Firm* — William H. Bollman

(57) ABSTRACT

Various modular construction systems exist and these all have limitations of cost, adaptability and strength. Some were also complex and time consuming to assemble. The present invention overcomes these problems by providing a simple modular construction element (10), which can be assembled with one another to form a strong structure. The invention comprises sheet-like materials, has a V-shaped cross section and is adapted to receive a connector so that elements in use are connected, one to another. The element may be rhomboid shaped, hexagonal shaped or triangular shaped.

7 Claims, 7 Drawing Sheets

S = Sector Angle
t = Taper Angle
W = Wedge Angle

S = 180/9=20
t = 1/2(180/9)=10
W = 2t=S

MODULAR CONSTRUCTION ELEMENTS

BACKGROUND

The present invention relates to modular construction elements. In particular it relates to a system of elements for the purpose of construction, which are capable of being used in a wide range of applications including: buildings and as reinforcement for other structures. The construction elements are capable of being assembled in a manner which provides curved and spheroid surface shaped constructs.

PRIOR ART

UK Patent Application GB-A-2 335 211 (Roberts) describes a cup-like hexagonal construction element. Typically the elements are formed from a sheet of material, such as steel. FIGS. 1a and 1b of UK Patent Application GB-A-2 335 211 show plan view and front elevation views, respectively of one example of an element. The element is obtained by bending portions of a blank vertically to form walls, so that when assembled, one with another, there is defined a continuous passageway between adjacent elements. A plurality of such elements can be assembled together to form a honeycomb structure.

Published International Patent Application WO-A-9529305 (Evans) describes a construction module and system. In one embodiment module units for use as panels, comprise pleated hexagonal plates. In a further embodiment, which is explicitly stated as an alternative to spider bracing, two identical elements are co-joined i.e. cupped together and this is described at the passage on page 2 lines 13 to 22. The arrangements disclosed are principally for covering surfaces and appear to have limited tensile or compressive strength U.S. Pat. No. 3,844,083 (Farley) describes a wall or structural element made from a collapsible module which is hinged. All embodiments relate to hinged units which can be flattened. The inherent weakness, as a result of the hinges of the system in U.S. Pat. No. 3,844,083, are described and would appear to have limited tensile or compressive strength.

Another example of a lightweight construction element and system is described in U.S. Pat. No. 2,122,629 (Watson). U.S. Pat. No. 2,122,629 discloses a sheet metal structure made from bent structural sub-modules; these however are not identical to each other and consequently this increases their cost of manufacture. Moreover the system described has limited tensile or compressive strength.

A yet further example of a construction element and system is described in U.S. Pat. No. 5,560,151 (PolyCeramics) which discloses joining triangular hollow construction units to form hexagons/pentagons so as to enable a domed structure to be formed.

The aforementioned systems had limitations of cost, adaptability and strength. Some were also complex and time consuming to assemble.

It is an object of the present invention to provide improved modular construction elements which are strong and can be readily assembled into structures and allow greater control and adjustment between adjacent elements.

STATEMENT OF INVENTION

According to a first aspect of the invention there is provided a modular construction element comprising: a sheet-like material in the form of a rhomboid said element being adapted to receive at least two connectors, said element, in use, is adapted to be connected, to another element.

Ideally the modular construction element comprises a bent sheet-like material having chevron shape, said element lying in two planes so as to define a V-shaped cross section which subtends an angle ($\phi$).

A structure is formed from a plurality of elements assembled by way of connector elements whereby flat contiguous portions are in contact A structure is formed from a plurality of elements assembled by way of connector elements.

The element may be rhomboid shaped, hexagonal shaped or triangular shaped in plan. Typically the angle subtended by the V-shaped or chevron is between approximately 91° and 179°.

Ideally the angle subtended by the V-shaped or chevron is between approximately 91° and 179° . Typically, by varying the subtending angle, defined between planar portions of contiguous constructional elements, a radius of curvature in the assemblage is defined.

Ideally the element is used as a bracing unit with itself to form a modular construction, the walls of which construction can be connected one to another by means of a joint, which allows relative movement between the walls in two rotational degrees of freedom.

As previously mentioned, it is possible to impart a slight curvature to elements so as to form a domed structure. Elements forming the structure may be assembled together by suitable means, for example nuts on screws which pass through appropriate fixing holes of two or more sets of contiguous walls.

Curvature may be applied to the assembly to provide a domed structure with an assistance of a tensioning means such as a tie-bar.

Preferably connector elements comprise a bolt-type member inserted into holes in the walls and are fixed with nuts. Use of a pair of adjacent washers, one having a substantially concave surface the other having a substantially convex surface, provides an additional degree of movement. When the convex and concave surfaces of contiguous washers are compressed, they cooperate to allow movement of the joint, in two rotational degrees of freedom. Spacers may be co-located within the joint.

The inventor has determined that additional holes in the bases or walls of the elements, allows for the passage of fluid, liquid, paste, hardenable filler or any other liquid material, which could be used as re-inforcement, as a thermal or acoustic insulation medium, as a heat transfer medium, waterproofing substrate, fire retardant or for any other purpose.

It is appreciated that identical shaped chevron (V-shaped) elements allows for bracing using identical elements. That is sub-elements and bracing elements are one in the same. This embodiment appears to be the most commercially advantageous because the only variation (apart from size of modules) is the angle of cross section or the angle subtended by the V-shaped chevron. Therefore the V-shaped element that is singly and predominantly used is of identical construction elements which mean that only a single type needs to be used. It will be appreciated that elements, subtending a range of angles, may be formed from one template design.

Elements may be adapted to accommodate movement by way of at least two washers, which may include spacers or other means, which in use are placed adjacent one another. The washers or spacers accommodate variation of subtended angle by virtue of the first washer having a concave surface and the second washer having a convex surface, whereby in use, said convex surface contacts said concave surface. In an alternative arrangement both of the washers may be hemispherical.

In use the washers or spacers accommodate movement by virtue of the first washer having a concave surface and the second washer having a convex surface, said convex surface being in contact with said concave surface. In an alternative arrangement both washers may be hemispherical It will be appreciated that, in use, a bolt-type member may be threaded with said washers into appropriate holes in walls of a construction or structure formed from said elements. Similarly a construction may include a wedge between said walls co-located with, and by way of, said bolt-type member.

Ideally holes are provided in elements, so that the holes align in contiguous walls of contacting elements that make up the structure. This ensures penetration by threaded bolt-type members, (which may optionally bear washers with co-operating convex and concave surfaces and spacers) through holes or apertures in both elements.

The bolts may be fitted with corresponding threaded nuts. These may be tightened to clamp the washers, spacers, and contiguous walls of adjacent elements one to another.

The modular construction, when assembled from the elements, is ideally adapted to accommodate movement by way of at least two washers, spacers or other means, which, in use, are placed adjacent one another, whereby the overall construction is convex in one plane and optionally concave in a second plane, so as to define a vault, dome or saddle curve. Said second plane is ideally at right angles to the first plane.

In a related second aspect of the invention, there is provided a method of connecting two walls of structural modules comprising the steps of: placing a joint, which allows an amount of relative movement between the walls, thereby permitting displacement of the first wall in two-rotational degrees of freedom with respect to the second wall.

Again washers may be used to permit relative displacement and ideally the washers comprise a dish shaped washer adjacent to and in contact with a hemispherical washer.

Optionally an oversized aperture may be provided in the elements so that lateral movement of the bolt is permitted therewithin. Alternatively there may be an undersized bolt and this too permits an additional degree of freedom of movement.

The bolt type member is preferably a hollow threaded tube. In an enhanced embodiment a wedge or prism is also co-located with the bolt or fixing and the advantages of this are described below.

Where a liquid or semi-solid medium is introduced into contact with a part or fully assembled structure, a vibration device may be arranged to vibrate or jiggle a structure so that energy is transmitted through the structure, thereby expelling air pockets, and promoting the passage of the liquid medium through the holes. An advantage is that a pre-stressed concrete structure can be readily fabricated using a lattice or framework formed as a construction from the elements and the vibration of the liquid concrete can be used to distribute the concrete evenly and reduce the risk of voids within the structure.

In the pre-stressed concrete construction embodiment, the invention may be incorporated as a casting to form floors, levels, steps, walkways or similar such structures.

The invention may be augmented with use of a construction element co-formed into a prism. Prisms may be solid or formed from relatively flat, planar items which are folded into prismatic forms.

For the purposes of this description the term prism is intended to encompass both an object whose sides or faces are tapered or diminish in size, as well as one whose sides remain uniform and parallel. Thus, in the former sense the term prism includes a 'frustum' (or truncated pyramid); and in the latter the term prism applies to a solid of uniform cross section. It is understood that the base of the frustum can be any appropriate closed polygon.

The first and second flat portions may be defined in a single sheet of material or they may be defined by two separate portions, which are optionally capable of being joined one to another.

Ideally the prismatic portion(s) is/are formed from a single strip by way of bending or flexing along one or more lines of weakness. Alternatively the two flat portions may be hinged, so that modules may be stored or transported flat and assembled in situ. The base of the prism may be triangular, square, rectangular, hexagonal or any closed polygon.

The prismatic module is preferably a truncated pyramid. A plurality of such modules or blocks may be used to build a three-dimensionally curved surface.

Means may be provided to permit the two flat portions to be angled and interconnected so as to build a structure from a plurality of modules, for example so as to enable the construction of larger items such as walls, floors, roofs, struts, beams and other such items.

Alternatively elements which are chevron shaped cross-section units, said same units being adapted for use as peripheral bracing members. The chevron shaped cross-section units may be generally of equilateral triangular cross section.

Advantageously bracing and structural units are one and the same unit and comprise a bent sheet material of a generally V-shaped cross-section, ideally the included angle of which is approximately 60° , thereby permitting, in use, the formation of equilateral triangular networks, meshes, structures, shapes or forms.

Ideally a construction or building formed from said elements comprising a prism having tapered sides.

Said construction block may have a base in the shape of any appropriate closed polygon, for example it may be triangular, square, rectangular, or hexagonal.

In a particularly preferred embodiment the construction block is formed into a three-dimensional form, which has a curved surface.

An alternative to the frustum (truncated pyramid) embodiment is a construction block, which comprises a sheet section component with an integral fold, line of weakness, hinge or crease. Any appropriate shape may be used for the component; however, preferred template geometry is defined by two contiguous equilateral triangles having one common edge, making a parallelogram, rhombus or rhomb. The crease line ideally lies along the common edge between the two triangles, and divides each of the two greater angles of the template.

Holes through the template may be provided on each side of the crease or line of weakness. These allow threaded bolt-like members with corresponding threaded nuts to fix overlapping sheet components one to another. The component may be combined with others of its kind as a ply, forming a faceted or curved assemblage by means of the crease.

Symmetrical or irregular forms may be built by combining elements of the same angle of crease, or elements of different angles of crease respectively.

The invention will now be described by way of examples and with reference to the following Figures in which:

BRIEF REFERENCE TO THE FIGURES

FIG. 1*a* shows a plan view of a modular construction element with an integral fold, line of weakness or crease along its bi-sector;

FIG. 1*b* shows an overall view of an alternative embodiment of a construction element which has a hinge formed from a rolled end and pin;

FIG. 1*c* shows an overall view of the modular construction element showing the angle of fold (ϕ) along a line of weakness or crease;

FIG. 1*d* shows a side elevation of the modular construction element with an integral fold (ϕ), line of weakness or crease;

FIG. 1*e* shows a plan view of an alternative embodiment of a construction element which has a hinge formed from a rolled end and pin;

FIG. 1*f* is a side elevation of the construction element of FIG. 1*e;*

FIG. 1*g* shows a plan view of a further alternative embodiment of a construction element, formed from two parts, each part having a hinge formed from a tab and slot;

FIG. 1*h* shows a plan view of the embodiment of FIG. 1*g* with the parts separated;

Figure 5A:
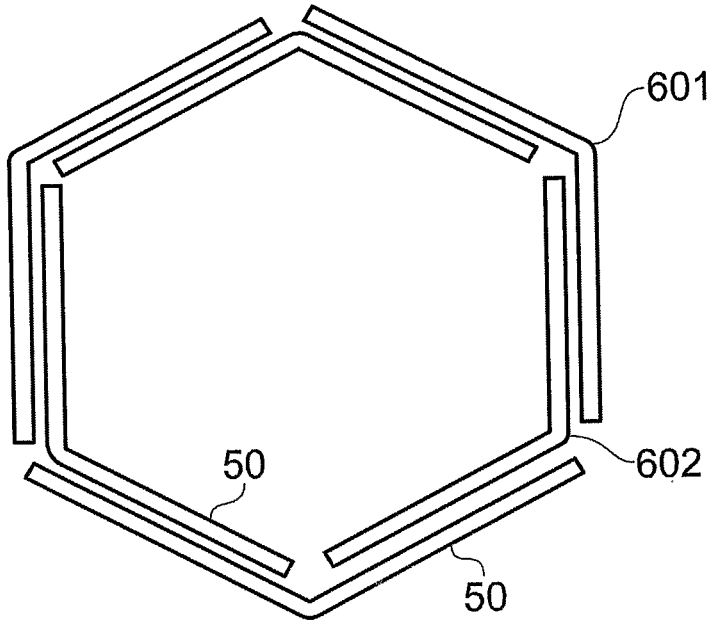
Figure 5B:
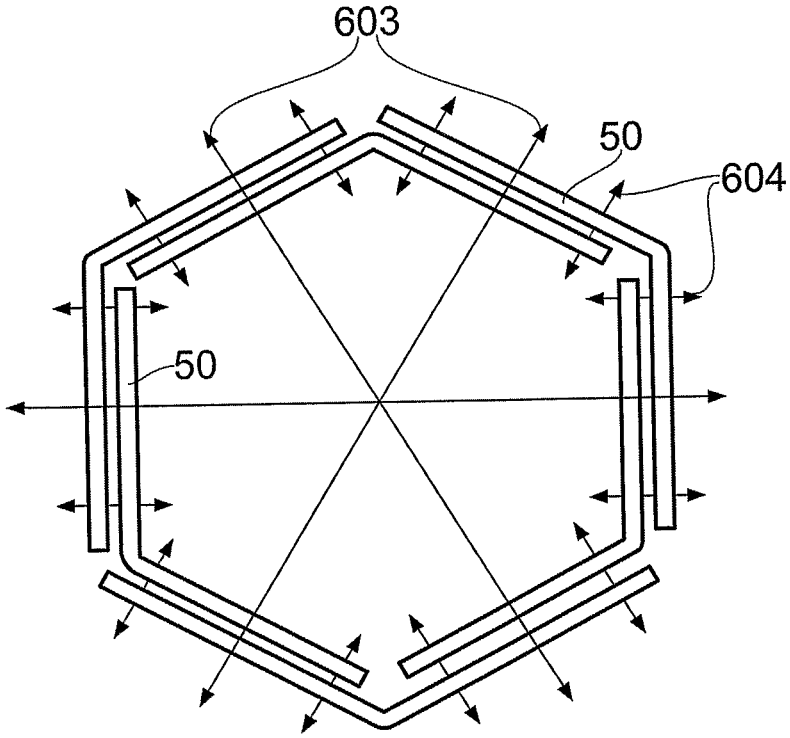
Figure 6A:
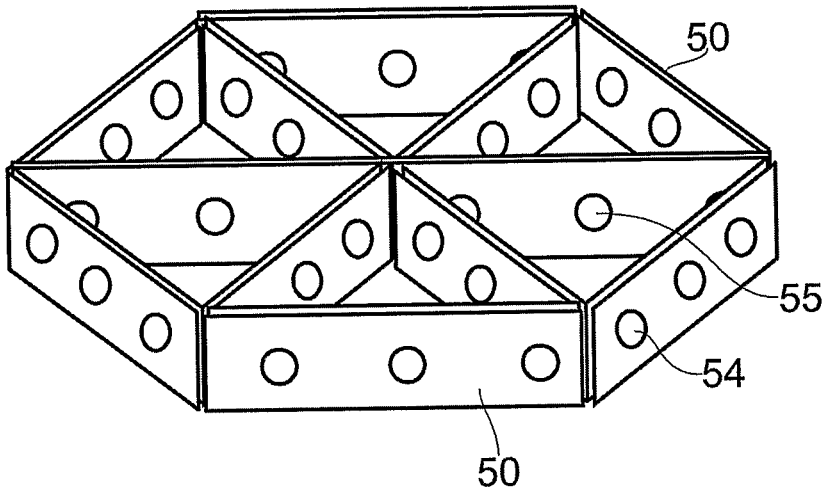
Figure 6B:
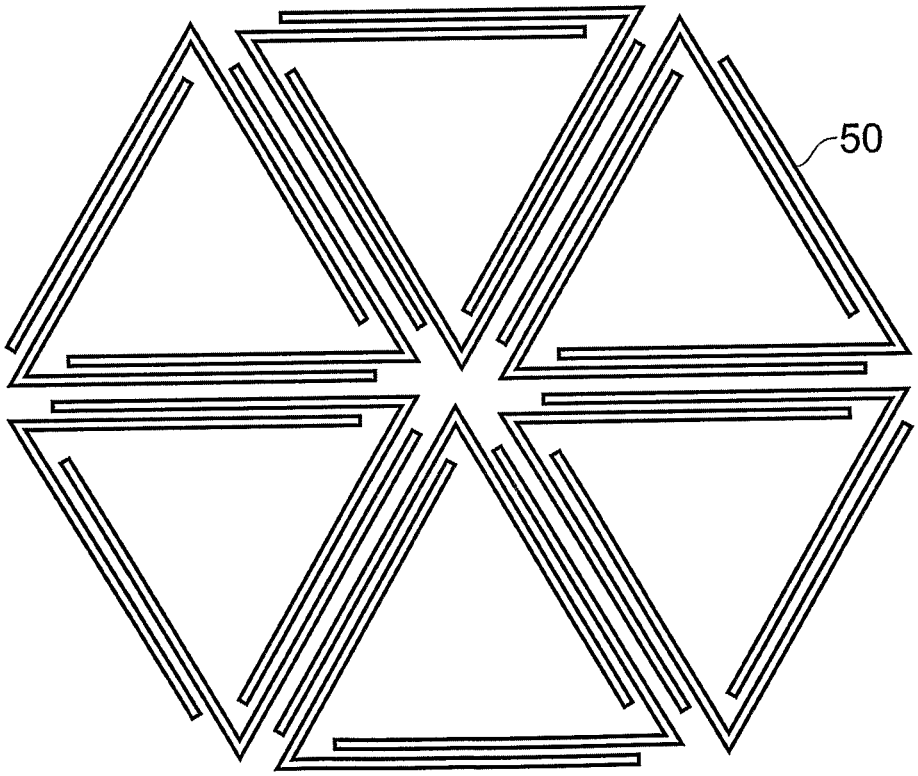
Figure 7:
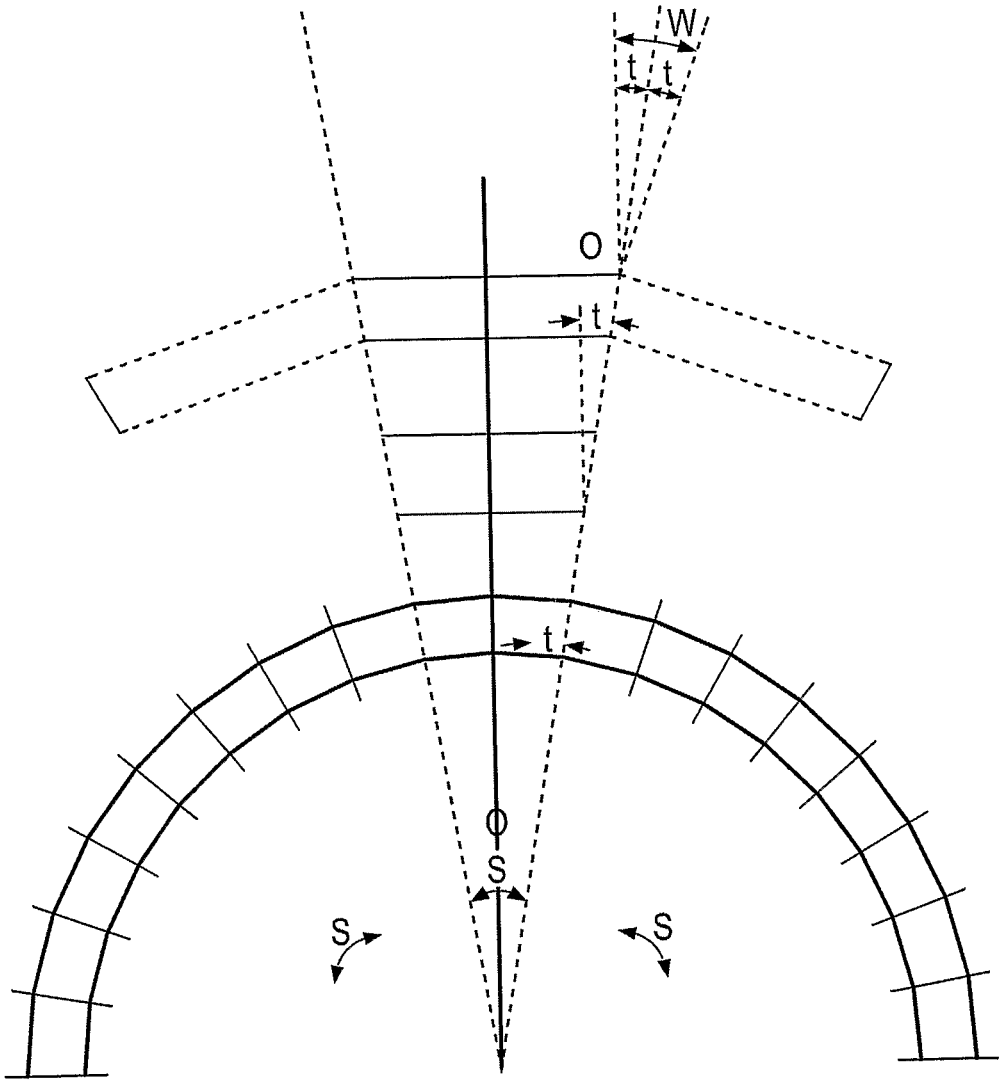

FIG. 5*a* shows plan views of six modules placed adjacent one another;

FIG. 5*b* shows a plan views of six modules interconnected by way of three rigid rods;

FIG. 6*a* is an overall, diagrammatical view of six modules positioned adjacent one another, in readiness for interconnection one to another, for example by way of rigid rods (not shown) through holes or apertures aligned throughout the assembled structure;

FIG. 6*b* is a diagrammatical plan view of an alternative embodiment of angled V-shaped elements placed in an arrangement in readiness for interconnection one to another and;

FIG. 7 is a diagrammatical overall side view of a series of tapered sub-modules arranged to form a curved structure.

DETAILED DESCRIPTION OF PREFERRED EMBODIMENTS OF THE INVENTION

Figure 1A:
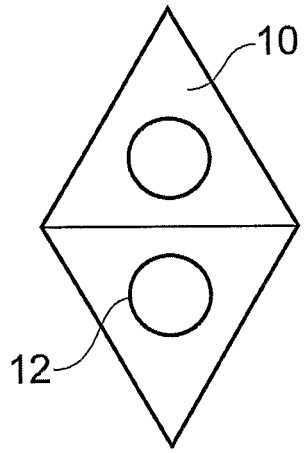
Figure 1B:
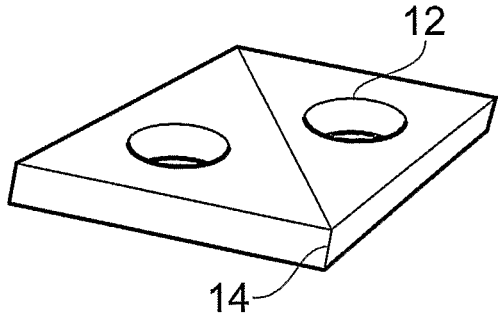

Referring to FIGS. 1*a* and 1*b* there are shown different views of modular construction element 10. The element 10 may be formed for, example by cutting or punching, a thin sheet of metal (not shown), such as sheet steel. The ideal shape of the element is diamond or rhomboid (rhomb). Apertures or holes 12 may be pre-formed into the metal sheet (prior to elements being cut) or cut or punched after elements 10 have been cut or formed. Elements 10 are then bent along bisecting line 14. At any stage of the process a line of weakness, such as a crease, fold or a scoring line may be formed on the metal sheet, so that this line is coincident with bisecting line 14 in an element.

Figure 1C:
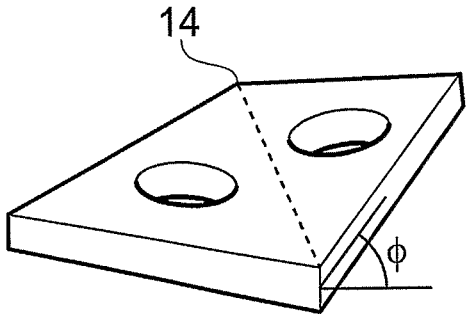
Figure 1D:
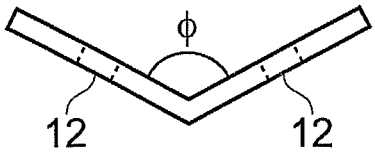

FIGS. 1*c* and 1*d* show an alternative embodiment of an element 10 formed from a sheet of material, in the form of a diamond, rhombus or rhomb. The sheet effectively comprises two contiguous equilateral triangles having one common edge. A crease or line of weakness 14 bisects the diamond shape. Line 14 ideally lies along the common edge between the two triangles, dividing each of the two greater angles of the template. The element 10 shown in FIGS. 1*c* and 1*d* is in bent form. If desired in a bent form, the final stage of production to be completed is a fold, along the line of weakness 14, about a pre-defined subtending angle (ϕ). The size of the subtending angle (ϕ) determines the radius of curvature of a domed structure.

Figure 2:
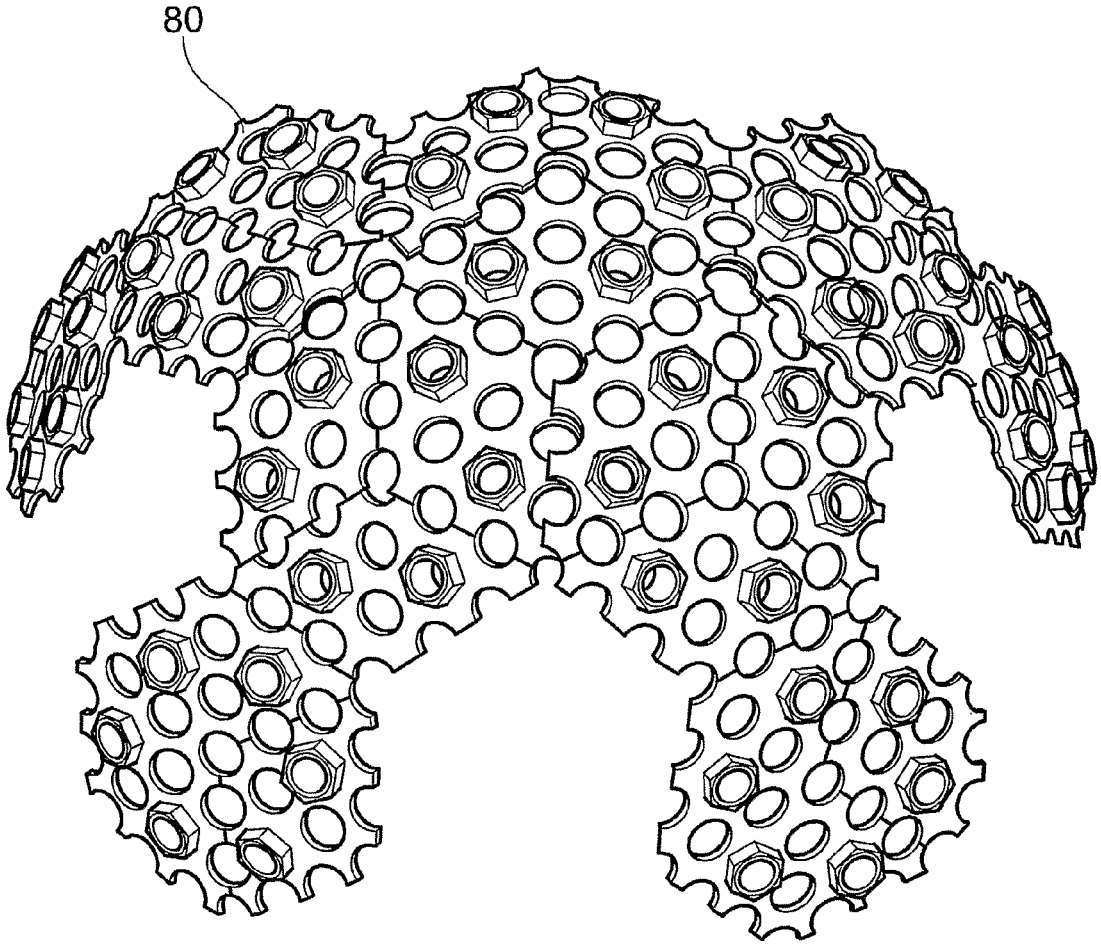
FIG. 2 is a diagrammatical overall side view of a plurality of modular construction elements arranged to form a curved structure.

FIG. 2 shows an overall view of a curved/domed construction formed from a plurality of elements, shown in FIGS. 1*c* and 1*d*, bolted together. Facets of the dome are flat rhomboids, and the curve is generated by varying the angle of creasing or the angle (ϕ) subtended by the folded rhomboid elements. In addition some variation between layers may be introduced by a washer and seat as described below.

Although described with reference to a metal sheet, a laminated structure may comprise layers of different materials, having different material properties to reflect a specific function. For example, a composite may be formed from two layers of steel elements and one layer of synthetic plastics (for example for use as a lightening conductor) or two layers of synthetic plastics or polythene for (waterproofing) and a third layer of fabric as a fire retardant.

Further layers may be added for sound proofing and/or heat insulation, and a veneer layer may be added for appearance. Alternatively areas of the ply or elements themselves may be formed from transparent material for light penetration.

Figure 1E:
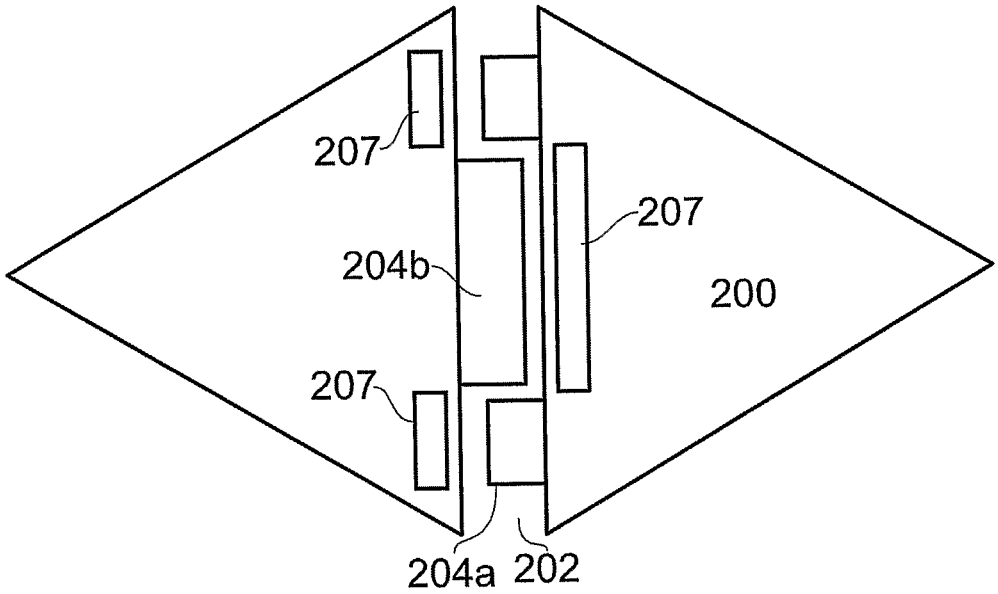
Figure 1F:
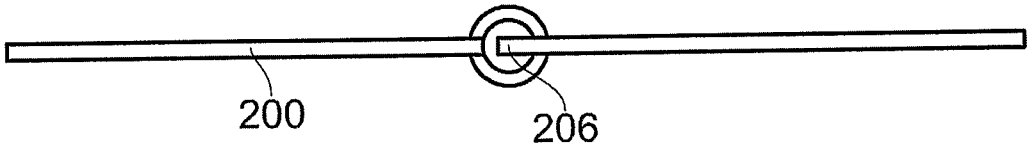

Referring to FIGS. 1*e* and 1*f* there are shown plan and side elevational views of an alternative embodiment of a construction element 200 which has a hinge 202 formed from rolled ends 204*a* and 204*b* and a pin (not shown). The pin may be a push fit, split pin or expanding rivet type, all of which permit rotation about axis 206. Alternatively ends 204 may comprise curved portions that act as claws or clasps and interengage with slots 207.

Figure 1G:
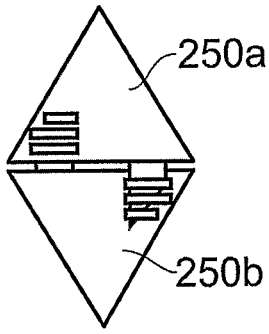
Figure 1H:
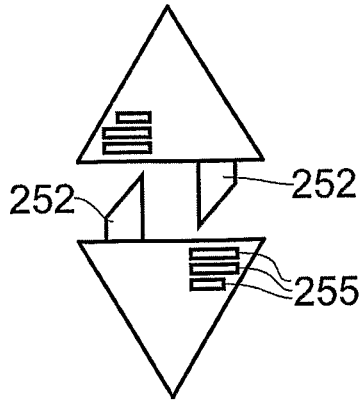

Referring to FIGS. 1*g* and 1*h* there are shown plan views of a yet further embodiment of a construction element, formed from two parts 250*a* and 250*b*. Each part 250 has a hinge formed from a tab 252 and a slot 255. The tab 252 slots into a series of apertures 255 which have been cut or punched in a sheet of material. Tab 252 is a relatively loose fit in slot 255 and this allows for flexing of the hinge. The two parts 250*a* and 250*b* are ideally identical in size and shape and this entails the production of only one type. It will be appreciated however that tabs may be formed on the right hand or left hand sides. FIG. 1*h* shows a plan view of the embodiment of FIG. 1*g* with the parts 250*a* and 250*b* separated.

FIG. 2 is an overall view of how elements are assembled into a domed structure with curved surfaces. It will be understood that use of different elements—with differing angles of subtended angle $\phi_1$ and $\phi_2$—permit complex curved structures, such as vaults, saddle curves or any other curved or part-curved surface to be fabricated.

Referring to FIGS. 3 to 7 in general, when assembled as hereinafter described, the elements 10 may be used to form an internal strengthening framework for a walkway, building or other construction, for example, by interconnecting them when flat in an array, and using the assembled structure as a reinforcing member (not shown). The reinforcing member may be used as part of a pre-stressed concrete structure (by placing the reinforcing member in tension) thereby increasing the strength of the overall composite structure. As an array of assembled elements 10 is effectively a large sheet, with apertures) pre-tensioning may be carried out in two axes, thereby creating a strong pre-stressed matrix.

Figure 3:
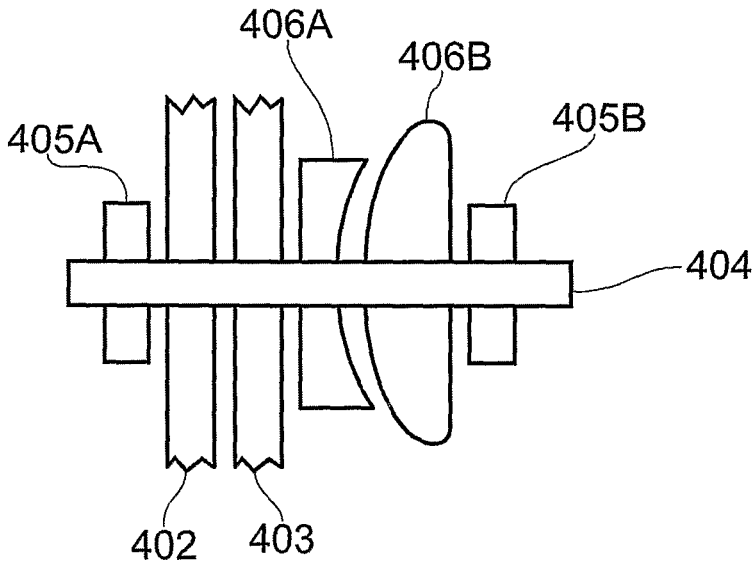
FIG. 3 shows a cross-sectional side elevation of a variable angle compressive side connecting joint for use with one embodiment of the invention.

Referring now particularly to FIG. 3, there is shown elements 402 and 403 (corresponding to elements 10) with two side walls 402 and 403 such as sheet metal connected and compressed together in contiguous alignment by means of an externally threaded pipe and two locking means, which are nuts 405A, 405B. Also included are co-operating dished and hemispherical washers 406A and 406B respectively. Such curved washers allow fixture of side elements at different angles without causing uneven pressure concentrations. The threaded pipe and nut fixtures can be set using variable torque forces and this allows greater control of the rigidity of the structure during construction.

Figure 4:
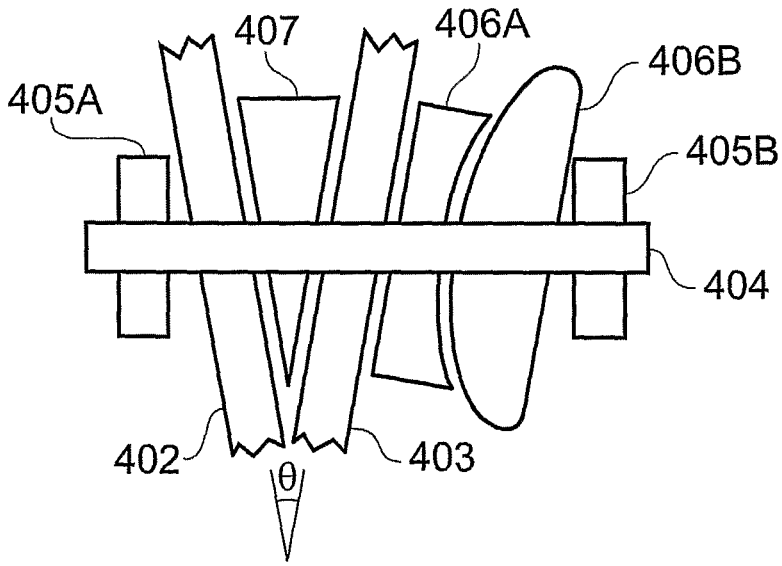
FIG. 4 shows a cross-sectional side elevation of a variable angle compressive side connecting joint including a co-located wedge shaped spacer for use with another embodiment of the invention.

FIG. 4 shows an enhanced embodiment of the invention; it is similar to the embodiment in FIG. 3 except that it includes a wedge or tapered spacer 407 between sidewalls, again allowing fixtures to be arranged with respect one to another at a chosen angle (θ), thus imparting a degree of choice to the user. In particular the wedge includes a hole, which allows elements to be co-located with a connecting joint, thereby ensuring it is fixed in the correct location. In FIG. 4, when nut 405A is tightened flush with respect to a slanted side of the joint, nuts 405A and 405B are aligned so that their faces are contiguous with the sheets 402 and 403.

Of course there are various alternative designs, which fall within the scope of the invention that would be known to the skilled person. A nut and bolt arrangement may replace the two nub balls and hollow tube arrangement. Also it is to be appreciated that the bolt type member may have a middle section devoid of threading to allow spacing.

FIG. 5*a* shows a construction element of a generally hexagonal form having peripheral bracing. It comprises six identical steel plates bent into chevron form units or components in chevron form. The outer plates 601 act as peripheral brace members for the hexagonal structure formed by locating the inner plates 602 as shown. Because the joint components are the same it reduces the number of types of components required.

FIG. 5*b* is an overall, diagrammatical view of six modules assembled interconnected by way of three rigid rods and shows holes or apertures disposed throughout the assembled structure. An enhanced embodiment of the invention may also include cylindrical steel tubes as well as pipe and nut fixtures as described previously.

FIGS. 6*a* and 6*b* show further embodiments of the invention wherein a hexagonal modular structural element is formed from components of equilateral triangular form. As can be seen from FIG. 6*b*, the triangular sub-modules and hexagonal module formed there from are formed and arranged to form interlocking v-shaped plates. These generally have an angle of 60° so as to form equilateral triangles.

As can be seen there is not a clear distinction between the structural walls and the bracings. This is termed 'integral' bracing. Again the advantage is that only one type of constructional element is needed.

It is to be understood that bent sheet material for the components does not have to be bent during their manufacture. Components may be moulded as such. Thus the term 'bent' should be construed to include any such element having sheet like portions, which are at an angle to each other and have a common edge.

The invention described hereinafter out lasts a design, which allows a curved structure to be built from an arrangement of a number of single modules. In the invention, curved sections eg. spheroid are built from tapered blocks (pyramid frustum).

FIG. 7 shows a cross-sectional view of how tapered prismatic blocks, with slanting sides may be assembled together to form a three-dimensional curve. The bases of the blocks may have any appropriate closed polygonal shape eg. triangular, rectangular or hexagonal.

Referring to FIG. 7, there is shown a diagrammatical overall view of a series of wedge shaped or tapered sub-modules arranged to form a curved structure. Ends of the sub-modules are angled or bevelled typically at a first taper angle θ. The wedges are arranged end to end to define an arc, curve or catenary and define a sector angle ϕ. An advantage of the structure is that is capable of flexing and adopting a shape that conforms to an applied force (not shown).

The term 'module' is intended to describe a complete hexagonal configuration. It may be beneficial to maintain this as a convention for future reference.

Although the invention has been described by way of preferred embodiments, it will be appreciated that variation may be made to the embodiments, without departing from the scope of the invention. For example, it will be appreciated that another application of the invention is for use as an architectural or any other modelling technique where a readily deployable system can be used to build a scale model quickly and cheaply.

Examples of applications of the invention have been mentioned and are not exhaustive.

Alternative embodiments, falling within the scope of the invention, are elements or constructs formed from perforated elements that could be used in ships or other vessels for storing, treating, processing, cooling or handling liquids.

It is well known that sea going vessels can be capsized by taking in a large amount of water which, if it is not controlled inside, can exaggerate the movements of their hulls, and destabilize and sink them. The invention may therefore be used as part of an internal water stabilisation system for such seagoing vessels. Likewise perforated tubular elements, installed in the hull of a vessel, could allow water in, and then restrict its movement, reducing the risk of capsize.

If a composite matrix sheet honeycomb structure were embedded in concrete, perforations in the metalwork enable fluid concrete to key into the matrix more effectively, thereby strengthening the structure.

Other applications of the element, when formed from suitable materials, and fabricated as a structure, include: a strong mesh, through which liquids may flow; which may act as a heat transfer matrix and which can flex.

Other variations to the aforementioned embodiments may be made without departing form the scope of the invention.

The invention claimed is:

1. A modular construction element comprising:

a single sheet of sheet-like material in the form of a rhomboid which lies in two planes formed by a crease along a bisector of said rhomboid so as to define a V-shaped cross section and which includes an aperture on either respective side of said crease which penetrates through a face of the sheet, said modular construction element adapted to receive connectors at each said aperture, whereby modular construction elements with faces of their sheets separated by contiguous washers with compressed concave and convex surfaces are connected in use face to face by a threaded bolt inserted through the washers and one of the apertures in each modular construction element thereby forming a joint that allows relative movement between the connected planes of connected modular construction elements in two degrees of freedom with each modular construction element wholly bracing the other.

2. A modular construction element as claimed in claim 1 wherein the angle subtended by the V-shaped or chevron is between approximately 1° and 179°.

3. A modular construction element as claimed in claim 1 wherein the angle subtended by the V-shaped or chevron is between approximately 145° and 165°.

4. A modular construction element as claimed in claim 1 wherein said joint comprises a pair of adjacent washers, one with a substantially hemispherical concave surface and the other with a substantially hemispherical convex surface.

5. A modular construction element as claimed in claim 1 wherein the joint comprises a threaded bolt-type member, which is threaded with said washers and which is inserted into appropriate holes in said connected modular construction elements.

6. A modular construction element as claimed in claim 5 including a wedge located between said connected modular construction elements and co-located with and by said threaded bolt-type member.

7. A wall comprising at least two modular construction elements defined according to claim 1 including bracing units, said bracing units being identical to said modular construction elements.

* * * * *